US005702014A

United States Patent [19]

Nielsen

[11] Patent Number: 5,702,014

[45] Date of Patent: Dec. 30, 1997

[54] CONTAINER HAVING A CHILD-PROOF, CUP-SHAPED CLOSURE

[76] Inventor: Arne Bendix Nielsen, Melbyvej 63, DK-3370 Melby, Denmark

[21] Appl. No.: 808,064

[22] Filed: Feb. 28, 1997

Related U.S. Application Data

[63] Continuation of Ser. No. 530,369, filed as PCT/DK94/00143, Apr. 6, 1994 published as WO94/22734, Oct. 13, 1994, abandoned.

[30] Foreign Application Priority Data

Apr. 7, 1993 [DK] Denmark ..... 0418/93

[51] Int. Cl.[6] ..... B65D 55/02

[52] U.S. Cl. ..... 215/217; 215/44

[58] Field of Search ..... 215/216, 217, 215/218, 219, 220, 221, 222, 330, 43, 44; 220/360

[56] References Cited

U.S. PATENT DOCUMENTS

| | | | |
|---|---|---|---|
| 1,538,848 | 5/1925 | Dunnock | 215/330 |
| 2,597,307 | 5/1952 | Elkind | 215/220 |
| 3,497,096 | 2/1970 | Smith et al. | 215/217 |
| 3,739,933 | 6/1973 | Degaetano | 215/330 X |
| 3,794,200 | 2/1974 | Marks | 215/330 X |
| 3,822,027 | 7/1974 | Cherba | 215/220 |
| 4,119,232 | 10/1978 | Thornton | 215/222 |
| 5,251,776 | 10/1993 | Morgan, Jr. et al. | 220/360 |
| 5,533,633 | 7/1996 | King | 215/252 |

FOREIGN PATENT DOCUMENTS

| | | | |
|---|---|---|---|
| 2013321 | 5/1994 | Russian Federation | 215/222 |
| 1161322 | 8/1969 | United Kingdom | 215/222 |

*Primary Examiner*—Stephen Cronin
*Attorney, Agent, or Firm*—Abelman, Frayne & Schwab

[57] ABSTRACT

The invention relates to a container (1) with a child-resistant cup-shaped closure (10), the opening of the said container (1) being a neck (2) with an external thread (3) in the form of a thread groove (4) for interaction with a radial projection (15) on the internal circular side wall (11) of the cup-shaped closure (10), whereby the thread (3) has a blocking device in that side (4*a*) of the thread groove (4) which is in frictional engagement with the projection (15) when the closure (10) is being unscrewed, so that the projection is caught by the blocking device when unscrewing the closure.

2 Claims, 2 Drawing Sheets

CONTAINER HAVING A CHILD-PROOF, CUP-SHAPED CLOSURE

This application is a Continuation application under 37 C.F.R. of prior application Ser. No. 08/530,369, filed as PCT/DK94/00143, Apr. 6, 1994 published as WO94/22734, Oct. 13, 1994, now abandoned.

BACKGROUND OF THE INVENTION

1. Field of the Invention

The present invention relates to a container with a child-resistant cup-shaped closure, the opening of the said container being a neck with an external thread in the form of a thread groove for interaction with a radial projection on the internal circular side wall of the cup-shaped closure, whereby the thread has a blocking device in that side of the thread which is in frictional engagement with the projection when the closure is being unscrewed, so that the projection is caught by the blocking device when unscrewing the closure.

2. Description of the Prior Art

In order to prevent children from consuming dangerous liquids such as acid, paraffin, cleaning materials and like liquids as are often found in a household and are easily confused with beverages, it is known to equip such containers with a child-resistant closure, for instance by way of a screw cap or a similar device. Containers of this kind are also used to safeguard children from the consumption of tablets and like objects which are dangerous to consume.

A container is known from U.S. Pat. No. 3,497,096 with a child-resistant cup-shaped closure of the above indicated kind. The closure is provided with a single internal projection which normally slides along a helical groove on the neck of the container towards a position where the closure seals the container. At a rotary position short of the sealing position of the closure the projection may optionally pass through a passageway into a locking device or locking groove which in opposite directions of rotation extends a distance away from the passage. The thread and the locking groove has the same width everywhere. When screwing on the closure an axial force must be applied on the closure directed towards the container, whereby the projection slides into the locking groove when the projection is opposite the passageway. By rotating the closure in opposite directions, the projection will slide backwards and forwards in the locking groove, in that the rotations will inevitably cause it to hit either the one or the opposite end of the locking groove. Since the locking groove extends to each side away from the passageway, it is necessary when unscrewing the closure to know the position of the passageway and the projection on the thread and the closure, respectively, in order for the projection to catch the passageway and have the projection pulled out through it so as for the projection by its engagement with the thread to permit the closure to be unscrewed from the container.

The known container is thus encumbered with the disadvantage that it is difficult to determine the position of the passageway of the locking groove in relation to the projection, even if one is familiar with the mode of operation of the locking device. Moreover, it is difficult to screw the closure onto the known container.

It is the object of the invention based on the known prior art by a container with a child-resistant cup-shaped closure to provide such an embodiment of the locking device that, irrespective whether the position of the locking groove in relation to the projection is known or not, it will always be possible to feel this position so that the closure can be unscrewed. The embodiment must also be such that the fitting of the closure is performed in the same simple manner as by a standard screw-cap.

SUMMARY OF THE INVENTION

This object is obtained by a container of the kind referred to in the preamble, which container according to the invention is characteristic in that the width of the thread groove on the last portion of the rotation which is closest to the container, is expanded in axial direction in relation to the width of the remaining outermost portion of the thread groove, and in that the passage between the expanded portion and the remaining portion of the thread groove is configured as a stop to catch the projection of the closure.

When the closure is screwed onto the thread of the container, the projection will initially move in a frictional engagement with that side of the thread groove which is farthest away from the container until a seal on the end wall of the cup-shaped closure abuts the neck opening of the container. Due to the compression of the seal the frictional engagement of the projection with the said side of the thread groove will be increased in that the seal will thus become sufficiently compressed to seal the contents of the container. The thread groove thus has the appearance of a usual thread groove.

When the closure is unscrewed from the container, the projection will initially continue to be in frictional engagement with that portion of the thread groove which turns away from the container due to the flexibility of the seal which will seek to resume its normal thickness. After turning of the closure the tension stemming from the flexibility of the seal will be relaxed, after which the projection will be in frictional engagement with that side of the thread groove which is closest to the container. The projection will therefore now hit the stop formed by the passage between the expanded and the normal portion of the thread groove and be caught by the stop so that the closure cannot just be twisted past it.

The closure must therefore be turned a small angle in the opposite direction, after which an axial force can be exerted on the closure in the direction away from the container so that the projection is brought into frictional engagement with the side of the thread groove turning away from the container so as to permit the unscrewing of the closure from the container, at least until the projection has passed the stop.

When the projection is configured as a stop to catch the projection when this touches the stop, it is prevented that the application of an axially directed force on the closure in the direction away from the container by this position of projection and locking groove will bring the projection in frictional engagement with that side of the thread groove which turns away from the container.

As opposed to the known container with a child-resistant cup-shaped closure where it is very difficult to unscrew the cap because it is not possible to see from the outside when the projection enters the locking groove, nor possible from the outside to determine when the projection is locked in the locking groove, the container and the child-resistant cup-shaped closure according to the invention devise a far more simple technical effect, because it is possible when unscrewing the closure to feel when the projection meets the stop and is caught by it. Then, the closure must be turned in the opposite direction and be lifted followed by a new turning.

BRIEF DESCRIPTION OF THE DRAWINGS

The container with a child-resistant cup-shaped closure according to the invention will be described in closer detail in the subsequent detailed portion of the description with reference to the drawing, in which.

DESCRIPTION OF THE PREFERRED EMBODIMENTS

Figure 1:
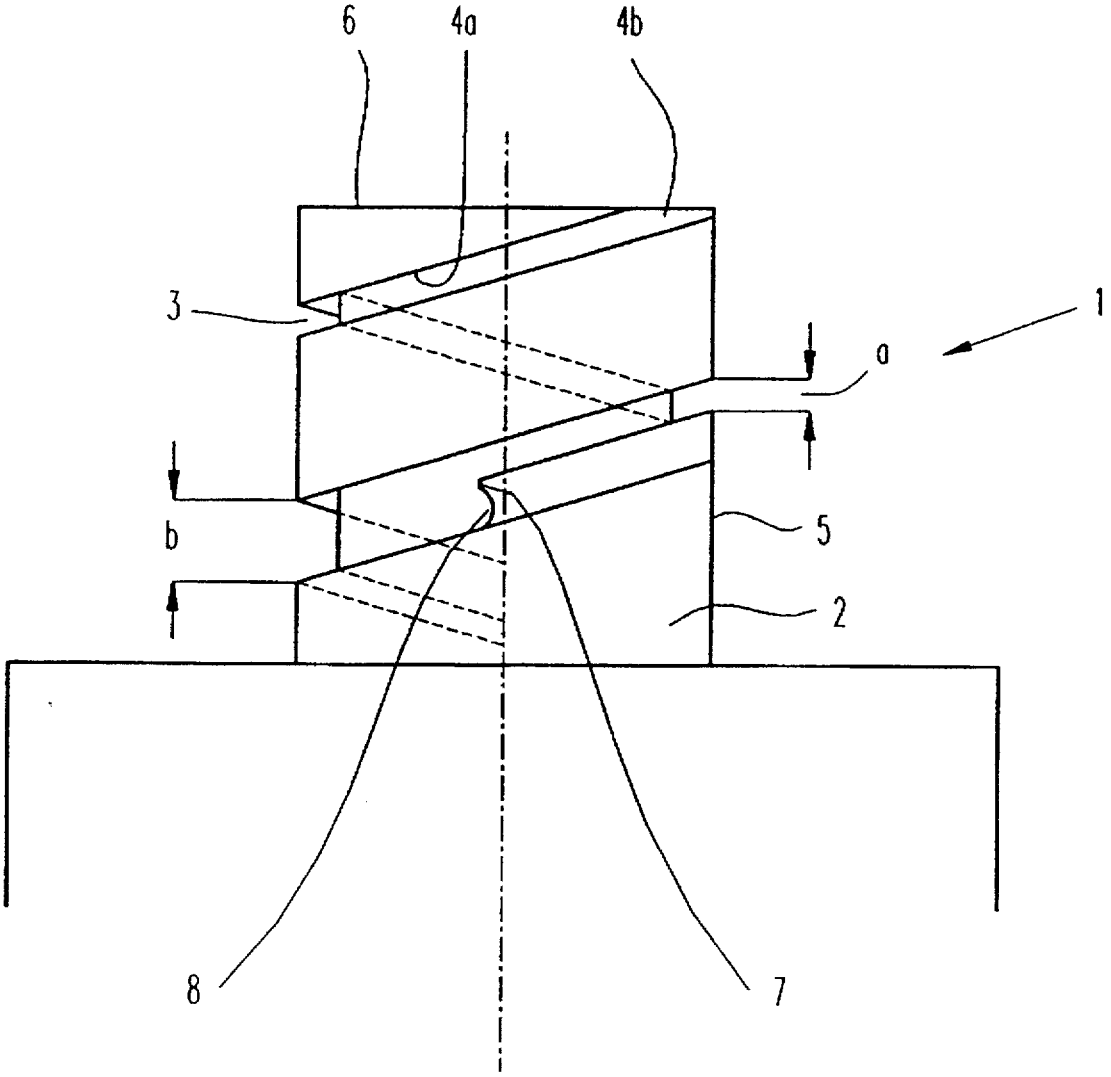
FIG. 1 shows a side view of part of a container according to the invention, which container has a neck with an external thread groove for interaction with a cup-shaped closure.

FIG. 1 shows the whole of a container with the reference numeral 1. The container 1 has a neck 2 provided with an external thread 3 which in the form of a thread groove 4 extends helically in a known manner on the outside 5 of the neck 2. The thread groove 4 has two sides 4*a*, 4*b*, of which the side 4*a* is the side farthest away from the container 1, and the side 4*b* is closest to the container 1.

Figure 2:
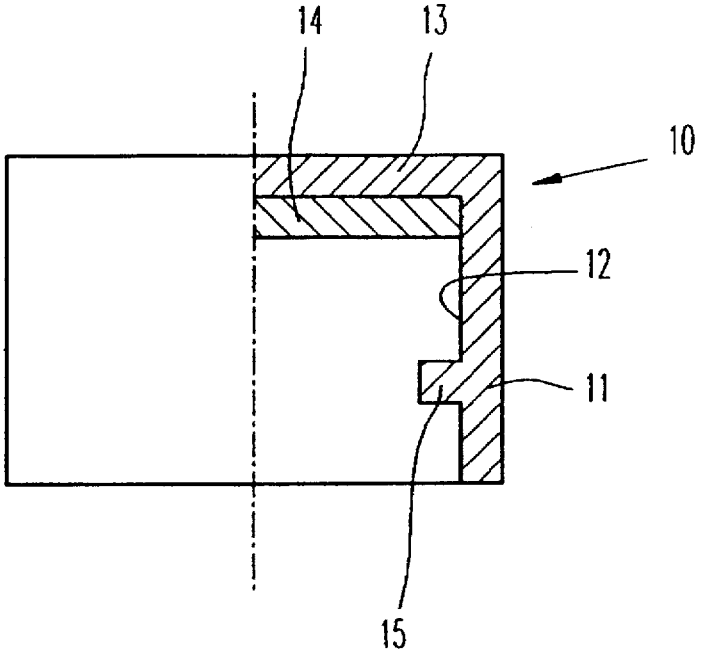
FIG. 2 shows a side view and a partial section of a cup-shaped closure to be used on the container shown in FIG. 1.

The thread groove 4 extends round along the outside 5 of the neck 2 of the container 1; if required, however, it may also describe more rounds. The neck 2 ends in an end surface 6 which can form the contact face for a seal 14 in a cup-shaped closure as shown in FIG. 2 and as a whole referred to by the reference numeral 10.

The outermost portion of the thread groove 4, i.e. that portion which is farthest away from the container 1 and forms the entrance to the thread groove, has a first width a seen in the axial direction of the neck 2, and the innermost portion of the thread groove has a width b which compared to the width a is preferably twice as wide. The innermost portion of the thread groove 4 with the width b extends the last distance around the outside 5 of the neck 2.

The passage between the narrow and the wide portion of the thread groove 4 is configured in such a manner that a stop 8 is provided extending a distance below the wall 4*b* at the passage to the narrow portion of the thread groove 4 as shown more clearly in FIG. 3. This embodiment of the stop 8 produces a beak 7 which can catch a projection 15 on the closure 10 as will be explained below.

The closure 10 is cup-shaped and has a circular side wall 11 with an inner surface 12. The closure furthermore has an end wall 13 which can be provided with the said seal 14. The inside 12 has a radial projection 15 designed so as to be able to engage and interact with the thread 3 on the neck 2 of the container 1 so that the closure can be screwed onto the container 1.

The projection 15 is preferably made with a circular cross section and is easy to manufacture.

The projection 15 is thus placed at such a distance from the end wall 13 of the closure 10 and the seal 14 that the seal 14 is compressed for the sealing of the contents of the container 1 when the closure 10 is screwed so tightly to the neck 2 of the container 1 that the projection 15 has passed the passage between the narrow and the wide portion of the thread groove 4.

When the closure 10 is screwed onto the thread 3 of the container 1 the projection 15 will initially move in a frictional engagement with that side 4*a* of the thread groove 4 which is farthest away from the container 1 until the seal 14 on the end wall 13 of the cup-shaped closure 10 rests on the neck opening or end surface 6 of the container. Caused by the compression of the seal 14 the frictional engagement of the projection 15 with the said side 4*a* of the thread groove 4 will be increased, thus providing the required sealing of the contents of the container 1.

Figure 3:
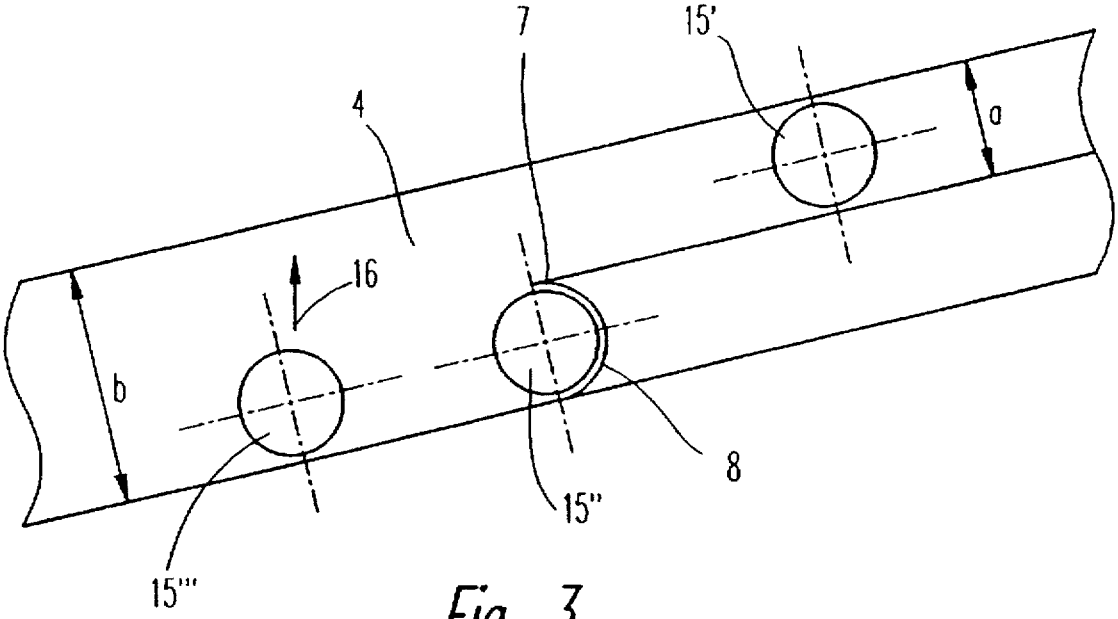
FIG. 3 shows an enlarged section of the thread groove shown in FIG. 1 where an internal projection in the closure shown in FIG. 2 is implied as being in engagement with the thread groove in three different positions.

This situation is illustrated in FIG. 3 where the projection is referred to as 15' in a position where the closure 10 is still not screwed so far down on the thread 3 that the projection 15 has passed the passage between the narrow and the wide portion of the thread groove 4.

When the closure 10 is unscrewed from the container 1, the projection 15 will at first still be in frictional engagement with the side 4*a* of the thread groove 4 being farthest away from the container 1 due to the flexibility of the seal 14 which seeks to resume its normal thickness. After a certain rotation of the closure 10 the tension stemming from the flexibility of the seal 14 will be relaxed, after which the projection 15 will be in frictional engagement with the side 4*b* of the thread groove 4 closest to the container 1. The projection 15 will therefore now hit the stop 8 produced by the passage between the wide and the narrow portion of the thread groove 4 and be caught there so that the closure 10 can not just be turned past the stop 8.

The design of the passage is configured complementary to the circular cross section of the projection 15, whereby a beak 7 is produced at the said passage or stop 8 which beak receives the projection 15.

When the passage is configured as a stop 8 with a beak 7 to receive the projection 15 when it contacts the stop 8, it is prevented that the application of an axially directed force on the closure 10 in the direction away from the container 1 by this position of the projection 15 and the thread groove 4 will bring the projection 15 in frictional engagement with that side 4*a* of the thread groove which turns away from the container.

This situation is illustrated in FIG. 3 where the projection 15 in the position where it is caught by the stop 8 and the beak 7 is indicated by 15".

The closure 10 must therefore be turned a small angle in the opposite direction, after which an axial force implied by the arrow 16 can be exerted on the closure 10 away from the container 1 causing the projection 15 to be brought in frictional engagement with that side 4*a* of the thread groove 4 turning away from the container 1, at least until the projection 15 is brought past the stop 8 for unscrewing the closure 10 from the container 1.

This situation is illustrated in FIG. 3 where the projection is indicated by 15"', where the axially directed force 16 has not yet been exerted.

In the description above the container 1 with a child-resistant cup-shaped closure 10 is described with an external thread 3 on the neck 2 of the container and with a projection 15 inside the cup-shaped closure. It will, however, be obvious to one skilled in the art that the thread in stead may be configured on the inside of the cup-shaped closure and the projection on the neck of the container. It is also obvious that the thread can be double or multi-threaded although the invention is explained by a single-threaded embodiment.

I claim:

1. A container (1) and child-resistant cap (10), said container (1) having an opening surrounded by an outwardly extending cylindrical neck (2), said neck having a single external thread groove (4) extending over at least one full rotation around said neck (2) for interaction with a radial projection (15) on an internal circular side wall (11) of said cap (10), whereby said thread groove (4) has a given width with a first side wall (4A) facing said container (1) (1) and a second side wall (4*b*) with a blocking device (7, 8), said second side wall (4*b*) being in frictional engagement with the projection (15) due to a compression of a packing (14) between said cap (10) and said neck (2) when said cap (10) is screwed onto said container neck, the width (b) of said thread groove (4) on a last portion of the rotation which last portion is closest to the container (1), is expanded in axial direction in relation to the width (a) of the remaining outermost portion of said thread groove (4), and in that a passage between said expanded portion and said remaining portion of said thread groove (4) is configured as a stop (7, 8) adapted to catch the projection (15) which lies freely in said thread groove (4) when said compression of said packing (14) is released due to unscrewing said cap (10), if said cap (10) is not pulled away from said container (1) in such a way that said projection (15) lies against said first side wall (4*a*).

2. The container (1) and child-resistant cap (10) according to claim 1, wherein the stop (7, 8) has a beak (7) designed to prevent movement of said projection (15) in an axial direction (16) away from said container (1) in such a way that said cap (10) after a slight twist in a first direction has to be turned a slight twist in the opposite direction to release said projection (15) from said beak (7) and then turned on further in said first direction.

* * * * *